US008651405B2

(12) United States Patent
Berndzen et al.

(10) Patent No.: US 8,651,405 B2
(45) Date of Patent: Feb. 18, 2014

(54) ROLLER MILL

(75) Inventors: Benjamin Berndzen, Münster (DE); Markus Berger, Ennigerloh (DE); Guido Scholz, Münster (DE); Franz-Josef Zurhove, Waldshut-Tiengen (DE)

(73) Assignee: Polysius AG, Beckum (DE)

( * ) Notice: Subject to any disclaimer, the term of this patent is extended or adjusted under 35 U.S.C. 154(b) by 202 days.

(21) Appl. No.: 13/124,195

(22) PCT Filed: Mar. 4, 2010

(86) PCT No.: PCT/EP2010/052774

§ 371 (c)(1),
(2), (4) Date: Apr. 14, 2011

(87) PCT Pub. No.: WO2010/102946

PCT Pub. Date: Sep. 16, 2010

(65) Prior Publication Data

US 2011/0240779 A1 Oct. 6, 2011

(30) Foreign Application Priority Data

Mar. 9, 2009 (DE) ..... 10 2009 012 353

(51) Int. Cl.
*B02C 15/00* (2006.01)

(52) U.S. Cl.
USPC ..... 241/117; 241/118; 241/119; 241/120; 241/121; 241/33; 241/36

(58) Field of Classification Search
USPC ..... 241/117–121, 33, 36
See application file for complete search history.

(56) References Cited

U.S. PATENT DOCUMENTS

| | | | | | |
|---|---|---|---|---|---|
| 3,344,998 | A * | 10/1967 | Eft | 241/103 |
| 3,612,418 | A * | 10/1971 | Barton | 241/118 |
| 3,658,264 | A * | 4/1972 | Schauer | 241/121 |
| 4,640,464 | A * | 2/1987 | Musto et al. | 241/34 |
| 4,694,994 | A * | 9/1987 | Henne et al. | 241/79.1 |
| 5,386,945 | A * | 2/1995 | Nose et al. | 241/30 |
| 6,081,059 | A * | 6/2000 | Hsu | 310/179 |
| 6,801,059 | B2 * | 10/2004 | Lee | 327/65 |
| 2003/0094524 | A1 * | 5/2003 | Scuccato | 241/299 |
| 2004/0021437 | A1 * | 2/2004 | Maslov et al. | 318/254 |
| 2006/0091755 | A1 * | 5/2006 | Carlisle | 310/168 |
| 2009/0127362 | A1 * | 5/2009 | Euculano et al. | 241/117 |
| 2010/0230520 | A1 | 9/2010 | Brammer et al. | |

FOREIGN PATENT DOCUMENTS

| | | | | |
|---|---|---|---|---|
| DE | 3602932 | | 8/1987 | |
| DE | 1977102854 | A1 * | 1/1997 | B02C 15/04 |
| DE | 1997102854 | * | 1/1997 | B02C 15/04 |
| DE | 19702854 | A1 | 7/1998 | |
| DE | 10305915 | A1 * | 2/2003 | B02C 15/00 |
| DE | 10305915 | A1 | 8/2004 | |
| DE | 102005045406 | | 9/2007 | |

* cited by examiner

*Primary Examiner* — Shelley Self
*Assistant Examiner* — Onekki Jolly
(74) *Attorney, Agent, or Firm* — Renner Kenner; Greive Bobak; Taylor & Weber

(57) ABSTRACT

The roller mill according to the invention substantially comprises at least one grinding roller and a grinding table, the grinding table having a grinding table inner space which is open in a downward direction, at least one grinding roller drive system for driving the grinding roller and a grinding table drive system for driving the grinding table. The grinding table drive system further has a gearless direct drive which is arranged in the grinding table inner space.

12 Claims, 1 Drawing Sheet

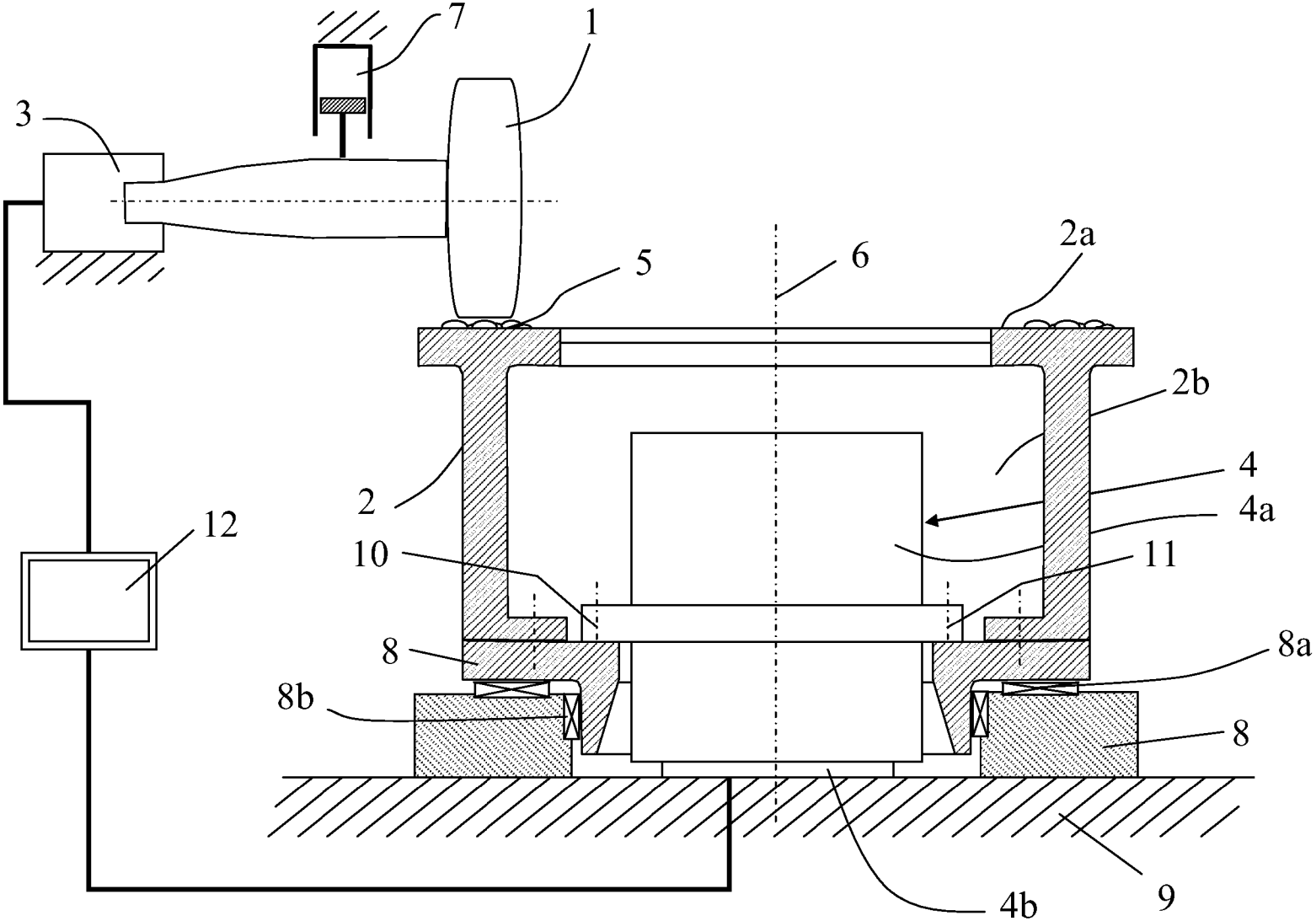
1
2
2a
2b
3
4
4a
4b
5
6
7
8
8a
8b
9
10
11
12

ROLLER MILL

The invention relates to a roller mill having a grinding table and at least one grinding roller which rolls on the grinding table.

Roller mills, which are also known as bowl mill crushers or vertical mills, are used in particular for the comminution of mineral raw materials and fuels, for example, in the cement industry or in power stations.

They are generally driven by means of a central drive of the grinding table, often also referred to as the grinding bowl. The rollers are mostly non-driven and are pressed by means of a force production device against the rotating grinding table, the stock being comminuted in the gap between the grinding roller and grinding table. In the case of large mills, owing to the large masses of the grinding rollers and the grinding table, there are occasionally significant fluctuations of power and torque in the event of irregular operation. Sooner or later, these lead to gear damage which results in significant repair costs and downtimes. This has serious detrimental effects on the production of entire factories or systems.

From DE 19 57 580 A1, it is already known to eliminate the gear mechanism which is susceptible to malfunctions and damage by the grinding table being driven by means of a ring motor. Since the grinding table speeds are between 15 and 35 rpm with conventional structural sizes, there are required for the necessary reduction of the mains frequency to the drive speed high numbers of pole pairs which in turn require the ring motor to have a large diameter. The ring motor can therefore be fitted only at the outer side of the table so that it does not collide with the gas pipes which supply the nozzle ring around the outer edge of the grinding table with gas from below and with the discharge ring and the downstream discharge device for grinding stock which has fallen through the nozzle ring. This results in a large spatial requirement. A ring motor must be assembled with a high degree of precision. Owing to its size and assembly position, it cannot be completely pre-assembled in a workshop, which results in a high level of assembly complexity and consequently high costs at the installation site. Furthermore, the power electronics of such a ring motor are associated with investment costs.

In place of a large grinding table drive system, DE 36 02 932 A1 discloses a combined drive comprising a grinding table and grinding rollers. In this manner, the entire drive power of the roller mill can be distributed over a plurality of drives. In particular, it is also conceivable for the drives to be configured in such a manner that a roller mill with n drives can also be operated with n−1 drives so that the repair of a drive can be carried out without the entire roller mill being shut down. The drive motor of the grinding table can be arranged, for example, next to the grinding table, but this requires a bevel gear step which in turn is the most frequent location for damage in current roller mill gear mechanisms. Alternatively, in DE 36 02 932 A1, it is proposed to arrange the motor below the grinding table. This configuration, with industrially conventional sizes, leads to an increase in height of the entire mill and the related external material transport operations, gas pipes and the necessary technical load transfers in terms of the building.

DE 10 2005 045 406 B4 describes the use of an electromotive direct drive which acts as a drive for a continuous press, but which is not suitable as a drive motor for roller mills.

An object of the invention is therefore to set out a roller mill whose grinding table drive system is characterised by reduced susceptibly to malfunctions and a grinding table drive arrangement which saves as much space as possible.

According to the invention, this object is achieved by the features of claim 1.

The roller mill according to the invention substantially comprises at least one grinding roller and a grinding table, the grinding table having a grinding table inner space which is open in a downward direction, at least one grinding roller drive system for driving the grinding roller and a grinding table drive system for driving the grinding table. The grinding table drive system further has a gearless direct drive which is arranged in the grinding table inner space.

The lower susceptibility to malfunctions of the roller mill according to the invention is achieved on the one hand by the entire drive power being divided with the grinding rollers on the one hand and the grinding table on the other hand being separately driven. Furthermore, with a gearless direct drive, it is also possible to dispense with the otherwise conventional gear mechanism which is susceptible to malfunctions for the grinding table drive.

Owing to the fact that a grinding roller drive system is also provided in addition to the grinding table drive system, the individual drives can be constructed to be correspondingly smaller so that the gearless direct drive can be arranged in the grinding table inner space in the first place and consequently an extremely space-saving arrangement is enabled.

From DE 197 02 854 A1, there is further known a roller mill whose grinding rollers are driven with an individual drive which is independent in each case. Furthermore, for approaching the roller mill there is integrated in the grinding table an auxiliary drive which has, however, a power level of only approximately from 2-5% of the total installed power of the roller mill. Such an auxiliary drive is further not suitable for continuous operation and requires a corresponding gear reduction which is achieved in this instance by means of a pinion which rolls on an internally toothed wheel or by means of a friction wheel.

According to the invention, however, there is provided not an auxiliary drive but instead, for driving the grinding table, a grinding table drive system which is suitable for continuous operation.

The dependent claims relate to other configurations of the invention.

The gearless direct drive of the grinding table drive system has at least from 10% to 40%, preferably from 15-30% of the total installed drive power of the roller mill.

According to another embodiment of the invention, the gearless direct drive has a rotor which is supported via the grinding table support of the grinding table. To this end, it is connected to the grinding table in a rotationally secure manner, in particular flange-mounted to the grinding table in a rotationally secure manner. The grinding table support is advantageously arranged on a base plate of the roller mill.

According to another configuration, the gearless direct drive has a stator which is supported on the base plate.

In order to accommodate the gearless direct drive, the lower portion of the grinding table is preferably constructed in a bell-like or cylinder-like manner, the gearless direct drive being arranged inside the bell-like or cylinder-like lower portion of the grinding table.

As a gearless direct drive, it is possible to consider, for example, a transverse flux motor or a high torque motor having an inner stator and an outer rotor. The high torque motor may advantageously have a rotor with permanent magnets.

Furthermore, the gearless direct drive is connected to an adjustment device for adjusting the direct drive to a predetermined drive torque. The direct drive can in particular be adjusted to a predetermined proportion of the total input power of the roller mill.

According to another configuration of the invention there is provided for the grinding roller drive system an adjustment device which is constructed, for example, as a power compensation adjustment device and which is further also connected to the gearless direct drive and which adjusts it to a predetermined proportion of the total power input of the roller mill. The direct drive is advantageously controlled by means of a frequency converter. Furthermore, there is advantageously used a gearless direct drive which can be connected directly to the electrical power supply network. Alternatively, it is also possible to use a speed-controlled direct current motor.

In the tests on which the invention is based, it has been found that with a configuration of the gearless direct drive of at least 10%, preferably from 15-30% of the total installed drive power of the roller mill and an appropriate adjustment system, as described, for example, in DE 10 2008 036 784 A1, it is possible to ensure extremely stable and balanced grinding operation.

Other advantages and configurations of the invention will be explained in greater detail below with reference to the description and the drawings.

The drawing is a schematic, partially sectioned side view of a roller mill.

The roller mill illustrated in the drawing substantially comprises at least one grinding roller 1, a grinding table 2, a grinding roller drive system 3 for driving the grinding roller 1 and a grinding table drive system for driving the grinding table 2, which has a gearless direct drive 4.

At the upper side of the grinding table 2 there is formed a grinding track 2*a*, stock 5 to be comminuted being comminuted in the gap between the grinding track 2*a* and grinding roller 1. During operation, the grinding table 2 rotates about its central, vertical axis 6, the grinding rollers 1 rolling on the grinding track 2 or on the stock 5 which is located therebetween and which is to be comminuted, the grinding roller 1 being pressed against the grinding table 2 by means of a pressing system 7.

The grinding table 2 has a grinding table inner space 2*b* which is formed, for example, by the lower portion of the grinding table 2 being constructed in a bell-like or cylinder-like manner so that the gearless direct drive 4 can be arranged in the grinding table inner space 2*b* or inside the bell-like or cylinder-like lower portion of the grinding table 2.

The grinding table 2 is supported via a grinding table support 8 on a base plate 9, suitable bearings 8*a* and 8*b* being provided.

The gearless direct drive 4 has an external rotor 4*a* and an internal stator 4*b*, the rotor 4*a* being flange-mounted on the grinding table 2 (see positions 10, 11).

In this manner, the direct drive 4 can be arranged in an extremely space-saving manner inside the grinding table 2. Owing to the special connection of the rotor 4*a* and the stator 4*b*, the rotor 4*a* does not require its own support, but is supported by the grinding table support 8 which is provided in any case. In this manner, optimum use is made of the structural space by machine elements (rotor bearing) which are not necessarily required being omitted or by machine elements (grinding table support 8) which are already available being used. This also includes the direct connection of the stator 4*b* to the base plate and the omission of couplings. Advantageously, the direct motor 4 can already be mounted on the base plate 9 in the workshop so that on the one hand a high degree of precision and on the other hand simple and rapid final assembly can be achieved in situ.

The gearless direct motor 4 can be formed, for example, by a transverse flux motor or a high torque motor, the rotor of the high torque motor being provided with permanent magnets.

In comparison with the mains frequency, relatively low speeds of the grinding table are required so that a direct drive with a high number of poles is required. The resultant low speed of the direct drive also has the advantage with asynchronous machines that speed fluctuations which are caused by load fluctuations from the grinding process are not fed back (reflected) in a highly exaggerated manner in the torsion vibration system. Dispensing with an additional gear mechanism also has the additional advantage that occurrences of play in the gear mechanism are eliminated and the susceptibility of the drive to malfunction is thereby clearly reduced.

The adjustment of the grinding roller drive system 3 and the direct drive 4 is carried out by means of an adjustment device 12. Owing to the provision of one or more grinding roller drive systems 3 and the direct drive 4 for the grinding table, the total installed drive power of the roller mill is divided over a number of drives. In the tests on which the invention was based, it has been found to be particularly advantageous for the direct drive to be configured in such a manner that it has at least from 10-40%, preferably from 15-30% of the total installed drive power.

The adjustment device 12 is configured in such a manner that it adjusts the gearless direct drive 4 to its predetermined proportion of the total power input of the roller mill. In addition, it can also be adjusted to a predetermined drive torque. The direct drive 4 is controlled, for example, by means of a frequency converter which is not illustrated in greater detail.

The arrangement of the direct drive inside the grinding table allows an extremely space-saving arrangement, the omission of the gear mechanism ensuring clearly reduced susceptibility to malfunction. Owing to the special connection of the direct drive 4 described above, additional structural space and costs are saved.

The invention claimed is:

1. Roller mill having a. at least one grinding roller, b. a grinding table, the grinding table having a grinding table inner space which is open in a downward direction, c. at least one grinding roller drive system for driving grinding table, such that the total installed drive power of the roller mill is divided over a plurality of drives, the roller mill characterized in that:

1) the grinding table drive system has a gearless direct drive which is arranged in the grinding table inner space, 2) the gearless direct drive has from 15% to 30% of the total installed drive power of the roller mill, and 3) the grinding table includes a lower portion that is constructed in a bell shaped or cylinder shaped manner, and the gearless direct drive is arranged inside the lower portion of the grinding table.

2. Roller mill according to claim 1, characterised in that the grinding table has a grinding table support and the gearless direct drive has a rotor which is supported via the grinding table support.

3. Roller mill according to claim 2, characterised in that the grinding table support is arranged on a base plate of the roller mill and the gearless direct drive has a stator which is supported on the base plate.

4. Roller mill according to claim 1, characterised in that the gearless direct drive has a rotor which is connected to the grinding table in a rotationally secure manner.

5. Roller mill according to claim 1, characterised in that the gearless direct drive is formed by a transverse flux motor.

6. Roller mill according to claim 1, characterised in that the gearless direct drive is formed by a high torque motor having an inner stator and an outer rotor.

7. Roller mill according to claim 6, the high torque motor having a rotor with permanent magnets.

8. Roller mill according to claim 1, characterised in that the gearless direct drive is connected to an adjustment device for adjusting the direct drive to a predetermined drive torque.

9. Roller mill according to claim 1, characterised in that the gearless direct drive is connected to an adjustment device which adjusts the direct drive to a predetermined proportion of the total power input of the roller mill.

10. Roller mill according to claim 1, characterised in that there is provided for the grinding roller drive system an adjustment device which is also connected to the gearless direct drive and which adjusts it to a predetermined proportion of the total power input of the roller mill.

11. Roller mill according to claim 1, characterised in that the gearless direct drive is connected to a frequency converter for the control thereof.

12. Roller mill according to claim 1, characterised in that the gearless direct drive is directly connected to an electrical power supply network.

* * * * *